United States Patent [19]

Hibler, Jr. et al.

[11] Patent Number: 4,549,734

[45] Date of Patent: Oct. 29, 1985

[54] RATCHET LOCK MECHANISM FOR EXERCISE HIP, LEG AND SQUAT SLED

[76] Inventors: Donald R. Hibler, Jr., Rte. 1, Box 36-H, Bates City, Mo. 64011; Ernest D. Mask, 311 Marion La., Lee's Summit, Mo. 64063

[21] Appl. No.: 515,303

[22] Filed: Jul. 19, 1983

[51] Int. Cl.[4] ..... A63B 21/00

[52] U.S. Cl. ..... 272/134; 272/117

[58] Field of Search ..... 272/117, 134, 136, 142, 272/144, DIG. 4

[56] References Cited

U.S. PATENT DOCUMENTS

| | | | |
|---|---|---|---|
| 3,820,782 | 6/1974 | Salkeld | 272/134 X |
| 4,252,314 | 2/1981 | Ceppo | 272/117 |
| 4,286,782 | 9/1981 | Fuhrhop | 272/117 |
| 4,316,608 | 2/1982 | Lundberg | 272/117 |

*Primary Examiner*—Richard J. Apley
*Assistant Examiner*—William R. Browne
*Attorney, Agent, or Firm*—Schmidt, Johnson, Hovey & Williams

[57] ABSTRACT

A multiple-duty leg exercise device is provided which includes a shiftable body-supporting pad respectively positionable in a use and a stowed position so as to permit alternate power hip or power leg exercises by the user. The pad is locked in respective positions by means of a ratchet-like mechanism including a pair of marginal, elongated apertured locking members and corresponding associated pivotal dogs coupled to the shiftable pad. The dogs include inclined forward surfaces which are successively cammed out of the aligned openings during shifting of the pad in one direction, and a trailing surface sequentially engaging the defining margins of the openings during rapid shifting of the pad in the opposite direction, in order to prevent the dogs from passing into the openings. When the pad is stopped in a desired position, gravity-induced pivoting of the dogs into the underlying locking member openings serves to lock the pad in place.

5 Claims, 7 Drawing Figures

RATCHET LOCK MECHANISM FOR EXERCISE HIP, LEG AND SQUAT SLED

BACKGROUND OF THE INVENTION

1. Field of the Invention

The present invention is concerned with an improved leg exercise device which is particularly designed for permitting various types of leg exercises to be performed thereon. More particularly, it is concerned with such a device having a lowermost, generally horizontal body-supporting pad which is shiftable between a use and a stowed position, along with an improved locking mechanism for selectively locking the pad in desired positions.

2. Description of the Prior Art

In recent years, there has been a tremendous increase in the number of persons interested in physical fitness in general, and in particular those involved in various types of exercise. One exercise regimen receiving attention in this respect is that of weight lifting, and indeed the beneficial effects derived from a weight lifting program are many, including improved muscle tone and overall fitness.

Traditional weight lifting equipment has involved little more than so-called "barbells" or other devices designed to present a fixed or variable weight lifting load for the user. However, in order to improve the usefulness of weight training, and also the safety thereof, a number of weight machines have been devised. These range from the simple weight bench to rather complicated multiple-station weight machines offering a variety of exercise alternatives. Such weight machines can vary in cost from only a few dollars up to many thousands of dollars, depending upon the complexity and degree of sophistication of the machine.

One area of particular concern to weight lifting enthusiasts is in the development of the legs and lower body in general. Here again, attempts have been made in the past to provide weight machines particularly adapted for leg and lower body development, but in many cases these are deficient in they do not provide the capability for performing a number of needed exercises (such as in the power hip, power leg and hack squat positions). This is particularly the case in relatively inexpensive leg exercise machines.

SUMMARY OF THE INVENTION

The problems outlined above are in large measure solved by the present invention which provides a greatly improved exercise device especially designed for leg and lower body development. Broadly speaking, the device includes a base, an elongated, upright support coupled to the base, with weight means shiftably mounted on the support for reciprocal movement thereon. Pad means is also provided for supporting a person lying in a supine position, with the pad means being selectively shiftable along a path of travel between a use position wherein the pad means is beneath the weight means and a person lying supinely on the pad can elevate his legs and engage the weight means with his feet, and a stowed position wherein the person can locate himself beneath the weight means for engaging the latter with the upper part of his body (such as shoulders), free of interference from the pad means.

Finally, the overall device includes means for selectively locking the pad means in the use and stowed positions respectively. Such locking means generally includes an elongated locking member having structure defining an aligned series of dog-receiving openings along the length thereof. This locking member is oriented along the length of the path of travel of the pad means. At least one elongated locking dog is pivotally coupled to the pad means, with the dog being located generally above the openings of the locking member and oriented for receipt thereof in respective positions of the pad means. The dog includes surfaces for engaging the member and permitting passage of the pad means along the length of the locking member without locking receipt thereof in the openings as the pad member is being shifted. Also, the dog means is pivotal to a locking position wherein the dog is lockingly received in a respective opening, when the pad means is stopped. Thus, a ratchet-like mechanism is provided which greatly facilitates fore and aft movement of the pad means so as to give a truly multiple duty machine at low cost.

DESCRIPTION OF THE PREFERRED EMBODIMENT

Figure 1:
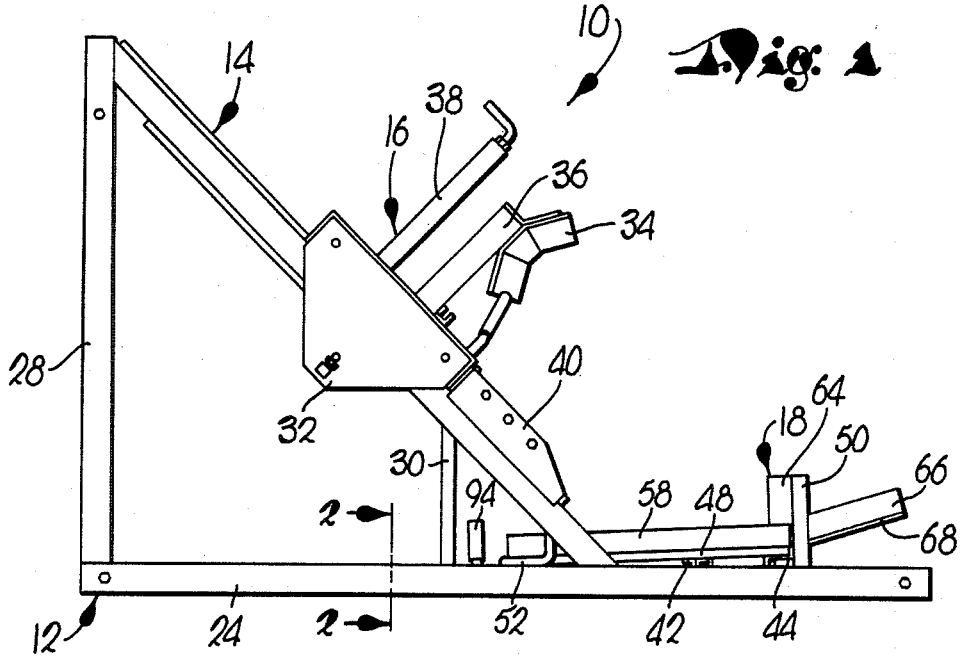
FIG. 1 is a side elevational view of an exercise device in accordance with the invention.

Turning now to the drawing, and particularly FIG. 1, it will be seen that an exercise device 10 is provided which broadly includes a base 12, a pair of elongated, laterally spaced apart, upright, obliquely disposed support rails 14 secured to base 12, weight means 16 shiftably mounted on the supports 14 for reciprocal movement therealong, and pad means generally referred to by the numeral 18 for supporting a person lying in a supine position thereon. Wheel means 20 are operatively coupled to the pad means 18 for selective shifting of the latter along a path of travel between a use and a stowed position for the pad. Finally, a locking mechanism broadly referred to by the numeral 22 forms a part of the overall device 10, and serves to selectively lock pad means 18 in the use and stowed positions respectively.

In more detail, the base 12 includes a pair of laterally spaced apart, elongated side rails 24, as well as a pair of endmost, transversely extending cross rails 26. The rails 24, 26 are interconnected, so that the underlying portion of base 12 assumes a rectangular configuration in plan.

Figure 2:
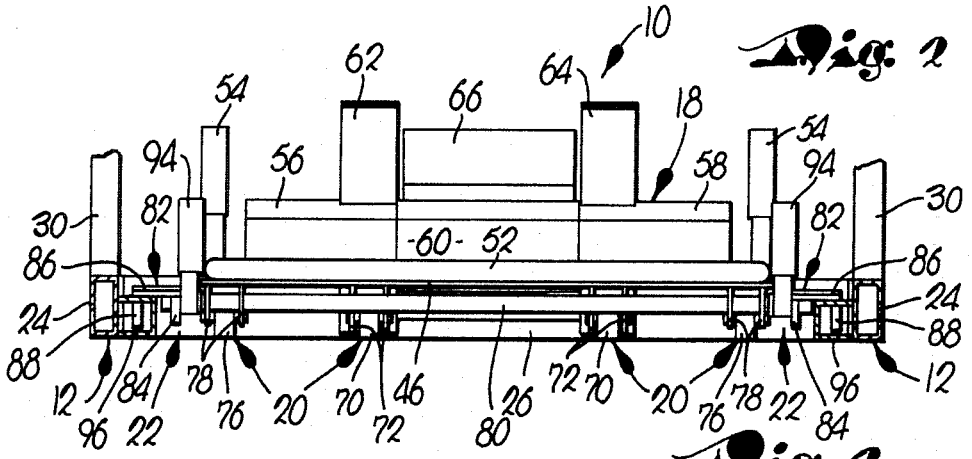
FIG. 2 is a vertical sectional view taken along line 2—2 of FIG. 1.
Figure 3:
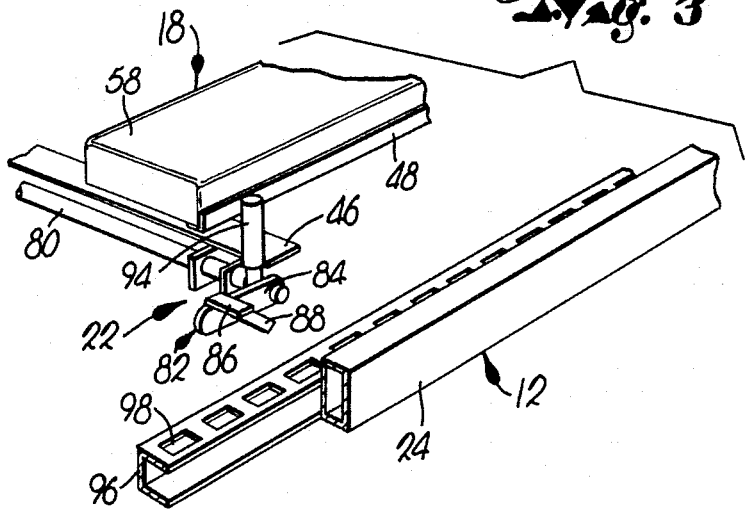
FIG. 3 is a fragmentary, exploded perspective view illustrating in detail components of the pad-locking ratchet mechanism.

The support rails 14 are connected to the underlying side rails 24 intermediate the ends of the latter, typically by means of welding. A pair of upright struts 28 are connected to base 12 adjacent the rearward end thereof, with the upper ends of the rails 14 being operatively connected to the upper ends of the struts to provide needed support. In addition, secondary struts 30 are interconnected between the oblique support rails 14, and the underlying side rails 24, to provide additional support (see FIGS. 1 and 2).

Weight means 16 include a pair of metallic shoes 32 respectively mounted on corresponding oblique rail 14 for reciprocal movement therealong. The shoes 32 are interconnected by laterally extending bar means (not shown) so as to reciprocate in unison and provide a region for engagement by the user's feet. In addition, the overall weight means 16 includes a pair of spaced apart shoulder pads 34 adapted to engage the shoulder of a user in the power leg or hack squat position, with the pads 34 being reinforced by means of bracing 36. Finally, a pair of laterally spaced apart, outwardly extending shafts 38 are provided on the weight means 16, and are designed to receive one or more circular, aperture free weights, so that the resistance offered by the weight means 16 can be varied at will. An adjustable stop 40 is also provided adjacent the lower end of each support rail 14, in order to limit the lower extent of the stroke of the weight means 16.

Figure 4:
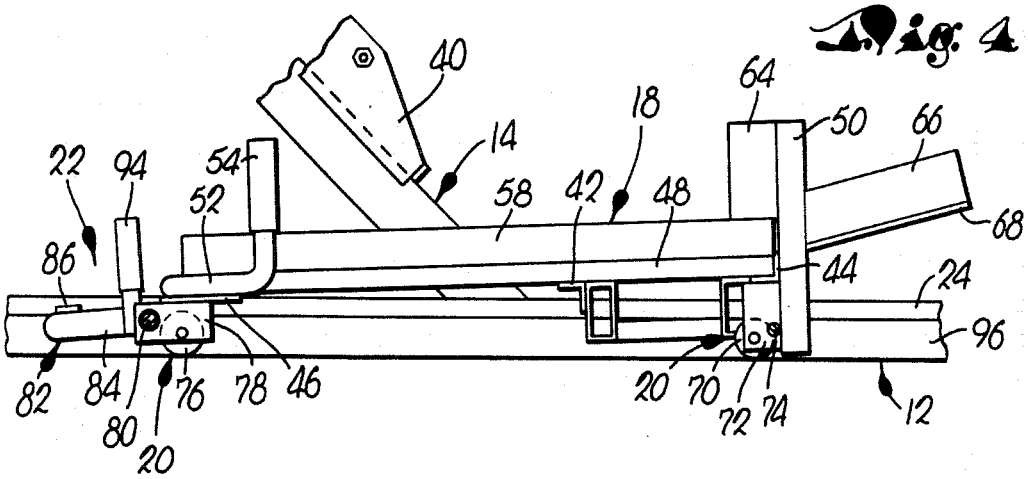
FIG. 4 is a fragmentary side view with parts broken away for clarity of the device illustrated in FIG. 1 and further depicting the construction of the pad means and locking mechanism.

The pad means 18 includes an underlying frame assembly comprising a pair of spaced apart, transversely extending angles 42, 44, a forwardmost, transversely extending, flat plate 46 and a pair of elongated, laterally spaced apart, side marginal angles 48. A pair of laterally spaced apart, relatively short, upright braces 50 are welded to angle 44 (see FIG. 4), whereas a rigid hand grip bar 52 is welded to plate 46 and has a pair of upstanding terminal hand grips 54. The overall pad means further includes a pair of side marginal, elongated pads 56, 58 which are fixed to the underlying frame, along with a removable central pad section 60 situated between the pads 56, 58. The section 60 is provided with underlying bracing 61 which is located between the marginal pads 56, 58. A pair of fixed, shoulder-engaging pads 62, 64 are respectively associated with the pads 56, 58, and are connected to the upright braces 50. A rearwardly extending, inclined, head-supporting pad 66 is affixed to central pad section 60 by means of an extension plate 68.

The pad means 18 is rendered shiftable by means of the wheels 20. Specifically, a first set of wheels 70 is rotatably supported by means of a pair of depending journal plates 72 for each wheel and fixed to the underside of angle 44. A pair of elongated, outwardly extending guide rods 74 are respectively secured to each associated outboard plate 72, in order to loosely guide pad 18 during fore and aft shifting thereof as will be described. Another set of wheels 76 is similarly supported adjacent the opposite end of the pad means 18 through use of a pair of depending plates 78 for each wheel 76, the plates 78 being affixed to the underside of plate 46.

The locking mechanism 22 includes an elongated, pivotal rockshaft 80 which is pivotally supported by the plates 78 (see FIG. 2) and extends transversely the entire width of pad means 18. A dog assembly 82 is affixed to each outboard end of shaft 80 and includes an extension leg 84, a horizontal tab 86, and an oblique, downwardly extending locking dog 88. The dog 88 includes an inclined leading surface 90, as well as a rectilinear trailing surface 92. An upright handle 94 is likewise affixed to rockshaft 80 in order to facilitate selective pivotal movement thereof for purposes to be described.

The overall locking mechanism 22 further includes a pair of elongated channel locking member 96 respectively situated adjacent the frame side rails 24 extending along the length thereof. Each member 96 includes a top wall having a series of elongated, slot-like, aligned dog-receiving openings 98 therethrough. As will be seen from a study of FIGS. 5–7, the respective locking dogs 88 are oriented above the openings 98 for passage into the latter.

Figure 5:
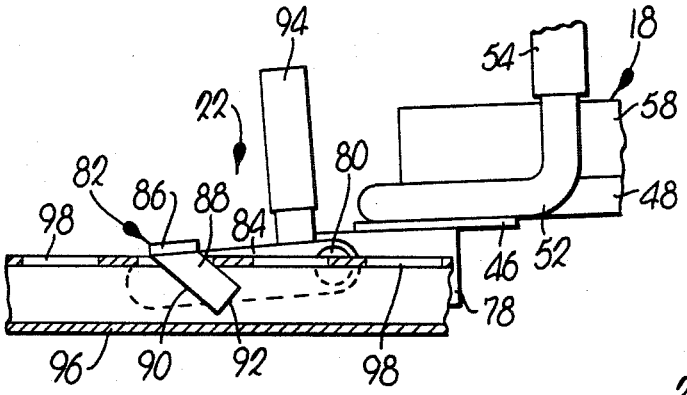
FIG. 5 is a fragmentary view in partial vertical section illustrating the locking mechanism wherein a locking dog is received within an associated opening for locking the pad means in a desired position.
Figure 6:
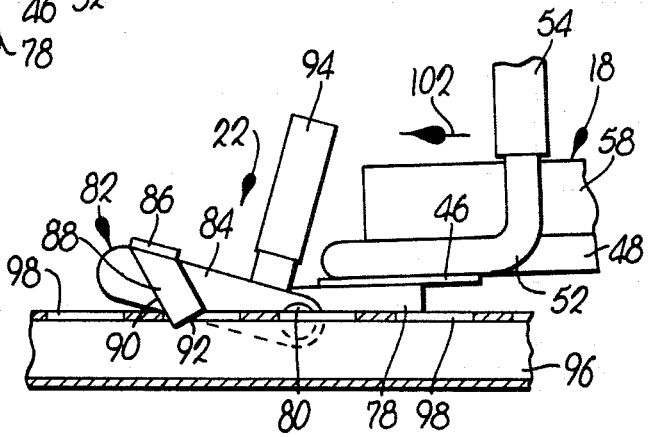
FIG. 6 is a view similar to that of FIG. 5, and illustrates the configuration of the locking mechanism during forward movement of the pad means.

When it is desired to use exercise device 10 in the power hip position depicted in FIG. 1, (wherein the user lies on his back with his feet engaging weight means 16 and his hands grasping handles 54), it is only necessary to assure that the pad means 18 is positioned so that the respective pivotal locking dogs 88 are lockingly received within underlying openings 98. This position of the overall locking mechanism 22 is depicted in FIG. 5. In this orientation, the pad 18 is securely locked, thereby affording the user a secure base for proper exercise.

If it is thereupon desired to use the device 10 in the power leg or hack squat position wherein the user is standing or sitting in an inclined position with his shoulders engaging the pads 34, it is only necessary to shift pad means 18 to a recessed, stowed position leftward of the position illustrated in FIG. 1, so that the desired exercises can be performed free of interference from the pad means 18. Such movement of the pad means 18 is accomplished simply by grasping the pad means at an appropriate location (e.g., at a handle 54) and pushing the shiftable pad means in the direction of arrow 102 (see FIG. 6). During such movement, the respective dog assemblies 82 ratchet out of the locking opening and permit the pad means 18 to be shifted to the stowed position. That is to say, during initial stages of this movement (see FIG. 6) the inclined surfaces 90 of the dogs 88 abut the adjacent walls of the associated openings 98 with the effect that the dogs 88, and hence the associated assemblies 82, are cammed out of locking relationship with the openings 98. Thereafter, the pad means 18 can be shifted along the length of the respective locking members 96, with the inclined dog surfaces 90 successively engaging the defining walls of the aligned openings 98 until the pad is stopped. At this point, the respective dogs 88 are allowed to again descend under the influence of gravity into the appropriate openings 98, whereupon the pad means 18 is again locked in position.

Figure 7:
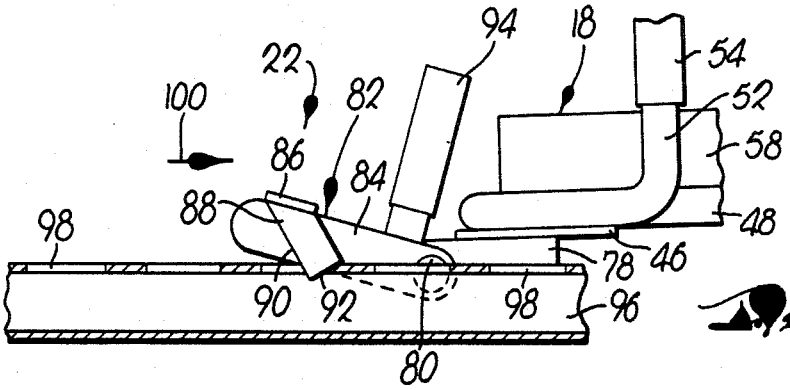
FIG. 7 is a view similar to that of FIG. 6, but illustrates the configuration of the locking mechanism during rearward movement of the pad means.

When it is desired to again use pad means 18, it is only necessary to shift the same rightwardly as viewed in FIG. 7 in the direction of arrow 100 until the pad means again assumes the position depicted in FIG. 1. Such reverse shifting involves merely grasping the handles 94 and pivoting the respective dog assemblies 82 in a clockwise direction as viewed in FIG. 7 until the associated dogs 88 are withdrawn from the corresponding openings 98. Specifically, the mechanism 22 is pivoted until the trailing surfaces 92 abut the adjacent walls of the corresponding openings 98, whereupon the pad means 18 is rapidly shifted in the direction of arrow 100. This causes the surfaces 92 of the dogs 88 to sequentially engage the defining walls of the openings 98, with the result that the dogs 88 will clear the openings 98 without becoming lockably inserted therein. Here again however, when movement of the pad means 18 is stopped, the dogs 88 pivot under the influence of gravity into underlying openings 98 for locking purposes. In addition, such fore and aft shifting of the pad means 18 is loosely guided by means of the guide rods 74 which extend from the outboard plates 72 to a point adjacent the members 96 and thus ensure that the dog assemblies 82 are properly oriented relative to the locking members 96 during shifting of the pad means 18.

We claim:

1. An exercise device, comprising:

a base;

an elongated, upright support operatively coupled to said base;

weight means shiftably mounted on said support for reciprocal movement therealong;

pad means located beneath said weight means for supporting a person lying in a supine position;

means for selective shifting of said pad means along a path of travel between a use position wherein the pad means is beneath said weight means and a person lying on said pad can elevate his legs and engage said weight means with his feet, and a stowed position wherein the person can locate himself beneath the weight means for engaging the latter with the upper part of his body, free of interference from the pad means; and means for selectively locking said pad means in said use and stowed positions respectively, said locking means including an elongated locking member having structure defining an aligned series of dog-receiving openings along the length thereof and oriented along the length of said path of travel;

an elongated locking dog; and means pivotally coupling said dog to said pad means, said dog being located generally above said openings and oriented for receipt therein in respective positions of the pad means along the length of said elongated locking member, said dog having surfaces thereon for engaging said member for permitting passage of the pad means along the length of said locking member without locking receipt thereof in said openings when said pad means is being shifted, said dog also being pivotal to a locking position wherein the dog is lockingly received in a respective opening, when said pad means is locked in a selected position.

2. The exercise device of claim 1, there being a pair of laterally spaced apart, elongated, upright, obliquely disposed supports, said weight means including a pair of interconnected shoes, each shoe being operatively coupled to an associated support for reciprocal movement therealong, and said weight means including a shaft means for receiving one or more free weights.

3. The exercise device of claim 1, said shifting means comprising floor-engaging wheels operatively connected to said pad means.

4. The exercise device of claim 1, said locking means comprising:

a pair of said locking members laterally spaced apart and respectively disposed adjacent the side margins of said pad means;

a pair of locking dogs, each locking dog of said pair of locking dogs associated with a corresponding locking member; and a pivotal shaft coupled to said pad means, said dogs being secured to the opposed ends of said shaft, said dogs being located generally above said locking members and pivotable downwardly under the influence of gravity into an engaging, locked position with said locking members.

5. The exercise device of claim 1, each of said locking dogs including an inclined leading surface for sequential camming of the dog out of and past underlying elongated member openings when the pad means is shifted in one direction, each of said dogs also having a trailing surface for sequentially engaging the defining margins of said openings to prevent the dog from passing into the openings during rapid shifting of said pad means in the direction opposite said one direction.

* * * * *